US009139260B2

(12) United States Patent
Pollack

(10) Patent No.: US 9,139,260 B2
(45) **Date of Patent: *Sep. 22, 2015**

(54) TENSION LEG CONNECTION SYSTEM AND METHOD OF INSTALLING

(71) Applicant: Single Buoy Moorings Inc., Marly (CH)

(72) Inventor: Jack Pollack, Houston, TX (US)

(73) Assignee: Single Buoy Moorings, Inc., Marly (CH)

( * ) Notice: Subject to any disclaimer, the term of this patent is extended or adjusted under 35 U.S.C. 154(b) by 79 days.

This patent is subject to a terminal disclaimer.

(21) Appl. No.: 14/010,774

(22) Filed: Aug. 27, 2013

(65) Prior Publication Data

US 2014/0017014 A1 Jan. 16, 2014

Related U.S. Application Data

(63) Continuation-in-part of application No. 12/673,840, filed as application No. PCT/EP2008/060808 on Aug. 18, 2008, now Pat. No. 8,628,274.

(30) Foreign Application Priority Data

Aug. 17, 2007 (EP) ..... 07114542

(51) Int. Cl.
*E02B 17/02* (2006.01)
*B63B 21/50* (2006.01)

(52) U.S. Cl.
CPC ..... *B63B 21/502* (2013.01); *E02B 17/02* (2013.01)

(58) Field of Classification Search
USPC ..... 405/203, 204
See application file for complete search history.

(56) References Cited

U.S. PATENT DOCUMENTS

| | | | | |
|---|---|---|---|---|
| 4,943,188 | A | 7/1990 | Peppel | |
| 6,022,174 | A * | 2/2000 | Husvik et al. | 405/223.1 |
| 6,352,116 | B1 | 3/2002 | Børseth | |
| 6,409,428 | B1 | 6/2002 | Moog | |
| 7,044,685 | B2 | 5/2006 | Wybro et al. | |
| 2003/0000447 | A1 | 1/2003 | Fontenot et al. | |
| 2004/0190999 | A1 | 9/2004 | Wybro et al. | |

FOREIGN PATENT DOCUMENTS

| | | |
|---|---|---|
| FR | 2 791 316 | 9/2000 |
| WO | 03/004347 | 1/2003 |
| WO | 2004/055394 | 7/2004 |
| WO | 2004/079146 | 9/2004 |

* cited by examiner

*Primary Examiner* — Benjamin Fiorello
*Assistant Examiner* — Kyle Armstrong
(74) *Attorney, Agent, or Firm* — Blank Rome LLP

(57) ABSTRACT

A floating construction having a base, a tensioning member extending from the sea bed in the direction of the base, a connector at an upper end of the tensioning member and attachment elements on the base for attaching to the connector, characterized in that, the attachment elements include a guide member for lowering a tensioning member section by a predetermined distance, which tensioning member section at a free end is provided with a complementary connector for attaching to the connector on the upper end of the tensioning member, the tensioning member section including at an upper end a stopper for engaging with the base and for fixing and/or adjusting the upper end in a vertical direction, the floating construction including a pulling device attached to the tensioning member section, for lowering the tensioning member section along the guide member towards the tensioning member.

10 Claims, 4 Drawing Sheets

TENSION LEG CONNECTION SYSTEM AND METHOD OF INSTALLING

Figure 1:
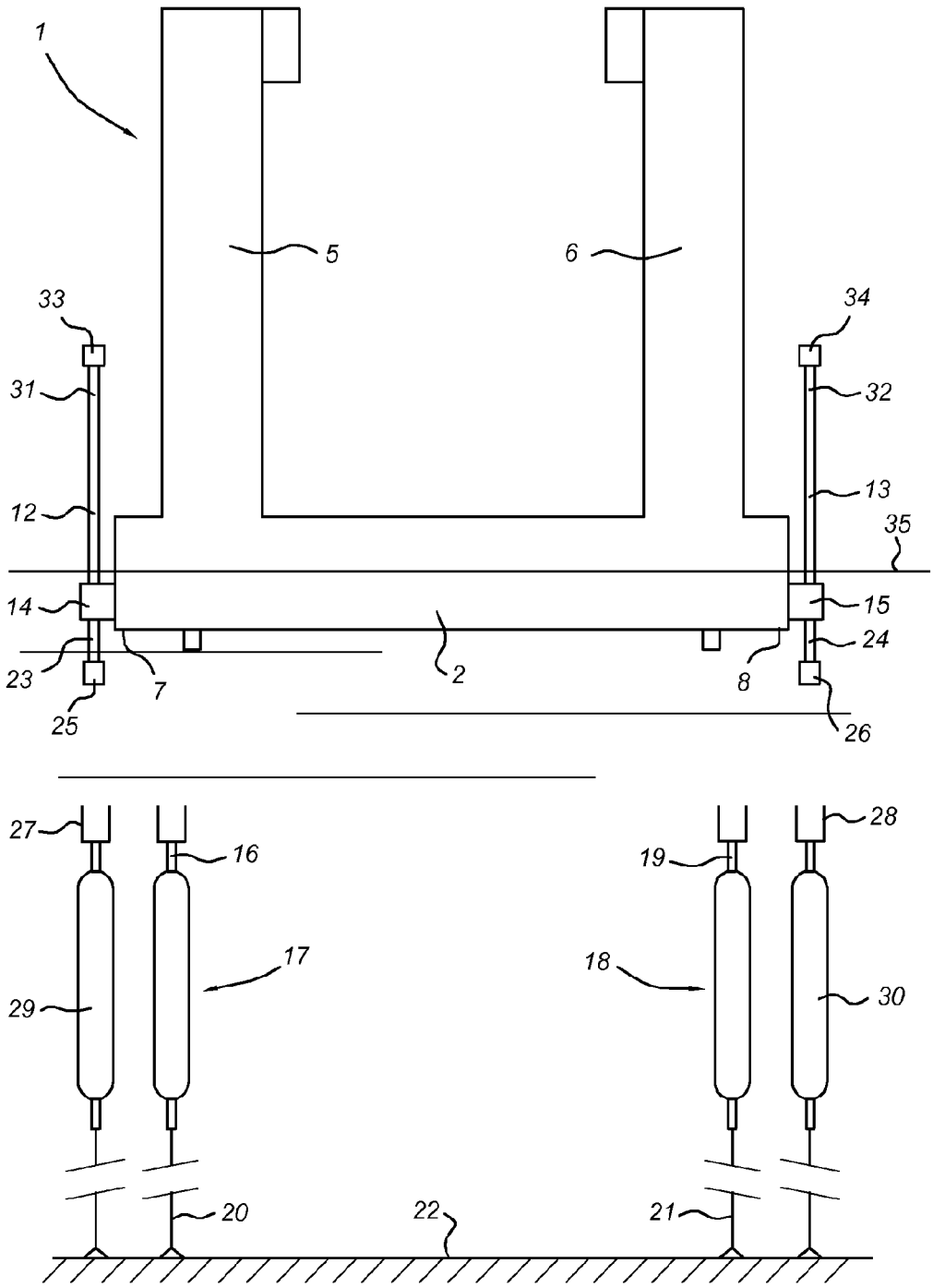

This application is a continuation-in-part of co-pending application Ser. No. 12/673,840, filed on Feb. 17, 2010, which is the national phase of PCT International Application No. PCT/EP2008/060808 filed on Aug. 17, 2008 under 35 U.S.C. §371, which claimed priority to European Application No. 07114542.9 filed Aug. 17, 2007 The entire contents of each of the above-identified applications are hereby incorporated by reference.

BACKGROUND OF THE INVENTION

1. Field of the Invention

The invention relates to a tension leg structure and to a method of installing such a tension leg structure.

2. Description of the Related Art

Tension leg platforms (TLP's) that are anchored to the sea bed via taut tendons or tension legs are generally known. For installation of the platform, which is often formed by a semi-submersible structure, the hull is towed to the installation site without its top structure attached. The hull of the semi-submersible structure is anchored to the sea bed via pre-installed tendons. The normal installation procedure of a TLP requires the platform to be connected to the pre-installed tension legs. For this, the TLP is towed to its final mooring position, after which the TLP is ballasted down to its lock-off draft (the draft at which a connection with the tension legs is made). The upper ends of the tension legs are then aligned with connection sleeves of the TLP hull, after which the tension legs can be clamped to gain a permanent connection. Finally, the TLP may be de-ballasted such that the TLP gains its operating draft and the tendons are tensioned.

When the TLP is in lock-off draft, the hull needs to be positioned precisely in line with the tension leg connection points, before the final connection can be made. The installation procedure not only requires precision at this point, but since the stability of the TLP may also be inadequate due to its reduced water-surface penetrating area, it also requires methods for providing stability during installation.

There are several ways to make a TLP more stable during installation. For example, a wider hull base may be used to increase the stability of the TLP, or the deck may be installed offshore after the hull is permanently moored. Offshore installation can only be done in good weather and it is expensive and dangerous. Another method to increase the stability during installation relies on the use of specialized installation equipment such as installation support vessels or temporary buoyancy vessels. Since there are only a small number of vessels capable of providing the required stability, this method is also costly.

U.S. Pat. No. 7,044,685 describes a method for installing a TLP by connection to its tendons using pull-down lines to rapidly submerge the hull to installation draft while compensating for inherent hull instability during submergence. The system includes tensioning devices mounted on the TLP, usually one for each tendon and clamping connection sleeves on each corner of the hull for attaching to the upper end of the tendons. The TLP is submerged to lock-off draft by applying a tensioning force to the pull-down lines connected to the top of the tendons. Additionally, the hull may be ballasted to aid in submerging the TLP. The TLP is then positioned such that the upper ends of the tension legs can be fixed inside the connection sleeves.

The above mentioned installation procedure provides improved stability during installation, since it provides a downward force at the various connection points. In this way, it is not possible for the unstable hull to capsize, since this requires that one side of the hull rotates upward. The downward force provided by the tensioning devices prevents this from happening. The known TLP installation method requires accurate control of the tensioning forces and the presence of relatively large tensioning devices on the TLP for providing the required lock-off draft.

The known connection of the upper ends of the tendons to the hull causes relatively large bending forces that are exerted on the releasable connection of the sleeves. Furthermore, the known method of connection of the upper ends of the tendons to the hull has as a drawback that the tendons must be accurately aligned with the connection sleeves, which requires positioning of the hull by the installation support vessel. All the different tension lines must be reeled in at a correct position, before said connection can be made. This is a time consuming task and requires a large degree of precision. The use of remote operating vehicles (ROV) is required to check whether each tension leg is in a correct connection position.

Once the known TLP has been installed, no length adjustment of the installed tendons is possible.

SUMMARY OF THE INVENTION

It is therefore an object of the present invention to provide a floating construction and a method of connection such a construction to tension legs, which avoids large bending forces on the connector and which can be rapidly anchored to the sea bed via pre-installed tension legs without the need for installation support vessels.

It is a further object to provide a floating construction which needs only be positioned with a relatively small degree of accuracy in order to obtain a proper connection.

It is another object of the invention to provide a floating structure and installation method which allows for easy inspection and exchange of one or more tendons or tendon sections.

It is again an object of the invention to provide a floating structure and installation method in which the tendon length can be re-adjusted individually without deballasting.

It is again another object of the invention to provide a floating structure and installation method in which the tendons can over their length be easily adjusted to prevailing conditions.

Hereto the method of installing the floating construction according to the present invention comprises the steps of:

providing pre-installed vertically oriented tendons having upper ends submerged below sea level at an installation site, floating the structure to the installation site;

ballasting the structure to an installation draft level, lowering a tendon section from the base by a distance below a bottom of the base, substantially in line with a respective pre-installed tendon, towards an upper end of the respective pre-installed tendon which at an upper end is provided with a connector, via a pulling device on the floating structure that is attached to the tendon section, connecting the connector at an upper end of the tendon with a complementary connector at a lower end of the tendon section, fixing the upper end of the tendon in a vertical direction on the base and, exerting a tensioning force on the tendons substantially without using the pulling device by deballasting of the base and placing the base in a moored state wherein the lower end of the tendon section is placed at a distance below the bottom of the base of between 1 m and 200 m, preferably between 5 m and 50 m.

The floating structure in the installation method according to the invention is designed to be stable at the installation draft, and requires no tensioning of the tendons by use of a complicated pull-down system for submerging the base and for providing stability. No additional installation support vessel for providing stability to the floating structure upon installation according to the invention is required.

The upper tendon sections are lowered by the pulling device on the base of the floating structure until the connector at the end of the upper tendon sections is located at a sufficient distance below the bottom of the floating structure, preferably below the wave active zone. The pulling devices according to the invention can be of a relatively simple and light-weight construction as no controlled pull-down of the entire floating structure is required.

By use of two-part tendons of which the upper tendon sections can be lowered from the floating structure, for instance along guide members, towards the connectors on the pre-installed tendons, it is no longer needed to pull in these pre-installed tendons prior to connection to the base. Firstly, the connection of the pre-installed tendon with the tendon section is made in a low-tension configuration. Preferably connection is carried out below the wave-active zone, via for instance a ROV. In the quite region at a depth below the wave active zone, the connection of the tendon segments can be carried out quickly and accurately without the risk of the connectors mutually clashing and resulting damage.

Only after connection of the upper and lower tendon sections has been carried out, the base is deballasted to tension the complete tendon assembly. The connectors remain submerged below the base of the floating structure, such that bending forces on the connectors remain low and can be taken up in the upper tendon section that extends between the connectors and the hull.

Connecting the upper and lower tendon sections can rapidly and reliably take place without the need of accurately positioning the floating structure for connection. The upper tendon section is sufficiently flexible to allow for excursions bridging the distance between the upper end of the pre-installed tendon and the freely depending upper tendon section upon connection.

Change out of the upper tendon sections according to the invention for inspection or replacement can be easily carried out without the need for disconnecting the lower tendon sections. By disconnecting the connectors at the ends of the tendon sections, the upper section can be retrieved on board of the floating structure using the pulling device without the need for an additional work-over vessel. Individual connectors coupling the upper and lower tendon segments, can be retrieved via the pulling device above water level for inspection, maintenance and change out for individual tendons, while other tendons are maintained under tension in their operational state.

The two-part or split tendon solution according to the invention allows the adjustment of the individual tendon length without further deballasting of the floating structure by paying out or taking in a predetermined length of the upper tendon section. Also a final adjustment of the total tendon length of the combined upper and lower sections can be made after installation by adjusting the length of the upper tendon section.

The guiding members on the barge along which the upper tendon sections pass, can be provided with a pivoting point such as flex-joint or a uni-joint. The complementary connector at the end of the upper tendon section will hence be located below the pivoting point.

The distance of the complementary connectors attached to the upper tendon sections, from the base or hull can be between 1 m and 200 m, preferably between 5 m and 50 m. By placing the connectors at a relatively large distance below the base or hull, bending forces can be properly kept within reduced limits. Furthermore, it is advantageous to lower the connectors to a position below the wave active zone in order to keep the forces on the connectors at a low level.

In one embodiment, the upper tendon section is flexible. In this way, the upper tendon section can be easily orientated during the connection to the lower tendon part, for instance by a guide wire or remote operated vehicle (ROV). The upper and lower tendon sections can be made of steel tubing, steel cables or rods, steel or synthetic wire rope or combinations thereof and may have different designs for the upper and lower sections.

In one embodiment, the pulling device comprises a winch on the floating construction and a cable extending from the winch to the top of the tensioning member section. In this way a simple means for lowering the connecting tendon sections is achieved.

Preferably the pulling device is adapted for lowering of the attached tensioning member and for exerting a tensioning force on the tensioning member without however being designed to be sufficiently powerful to pull the floating structure down to lock-off draft. Such relatively light-weight pulling devices may comprise a winch, ratchets, hydraulic jacks, and the like.

According to the invention, the upper tendon section may be constructed in a reinforced manner so that it can withstand the dynamics of the wave active zone in which it is situated and can be designed to resist fatigue weakening, while the lower tendon section can be executed in a lighter way, such that overall a more cost-effective tendon is provided.

The top of the pre-installed tendon section may at or near its upper end be provided with buoyancy means keeping the lower tendon section in a substantially vertical position. As the upper end of the lower tendon section can be placed below the wave active zone, the buoyancy means can be situated near the tendon upper end, near the connector which avoids buckling of the tendon, in contrast to the buoyancy member known from U.S. Pat. No. 7,044,685. A guide wire may extend from the base of the floating structure to the lower tendon section. Along the guide wire, the upper tendon section with the complementary connector may be effectively guided towards the connector at the top of the pre-installed tendon, which is held by the buoyancy into a properly defined connection orientation.

BRIEF DESCRIPTION OF THE DRAWING FIGURES

Figure 2:
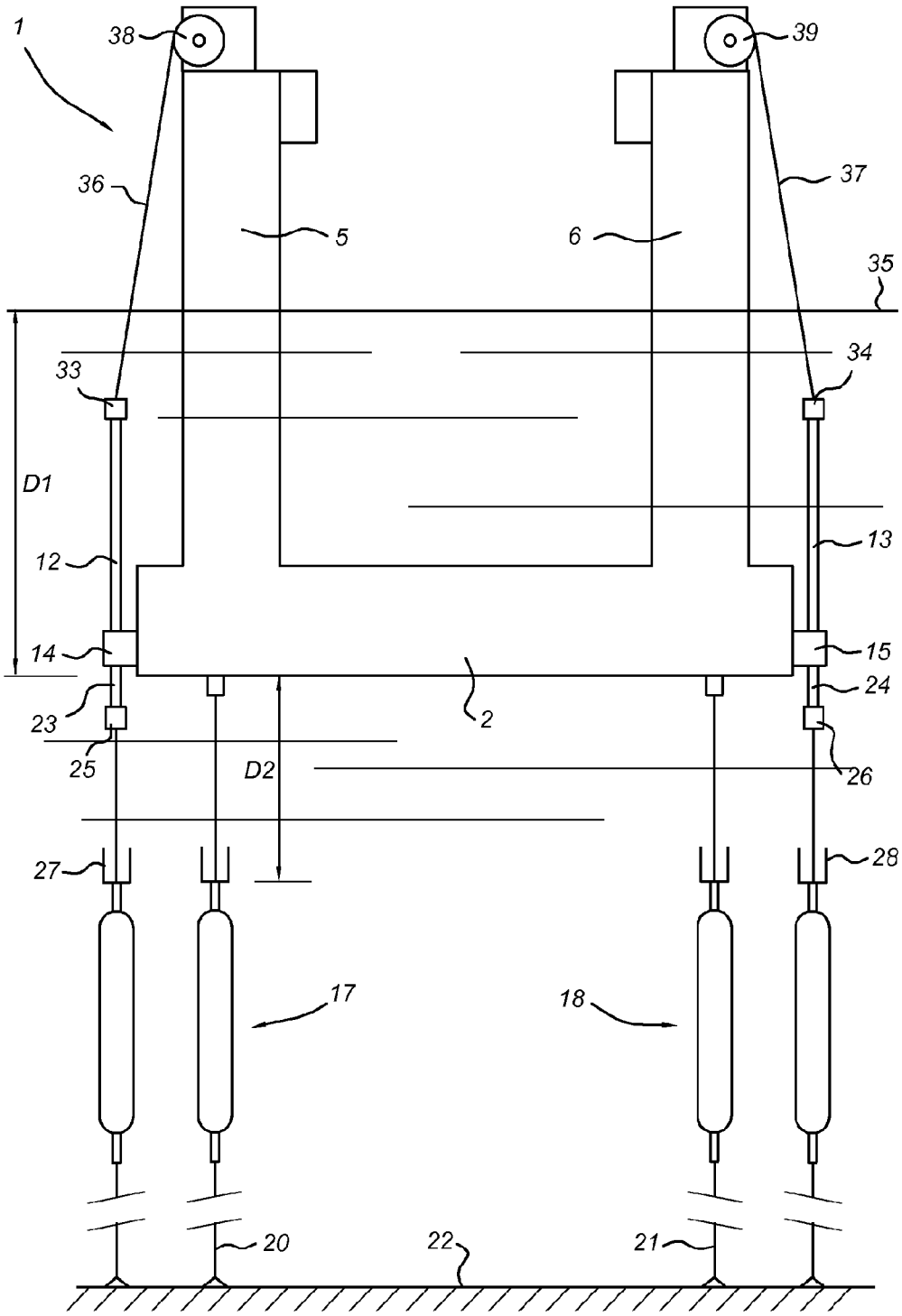
Figure 3:
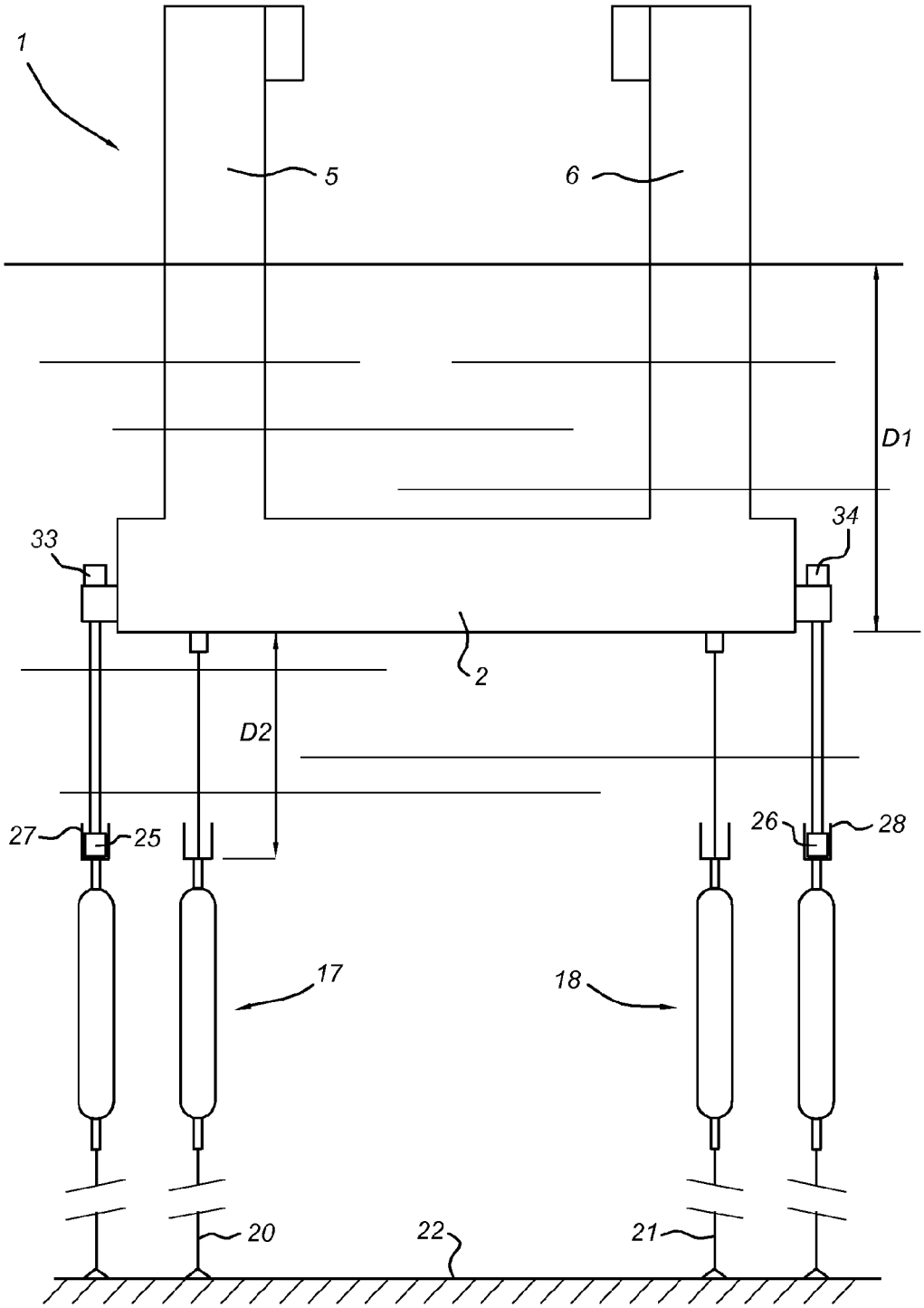
Figure 4:
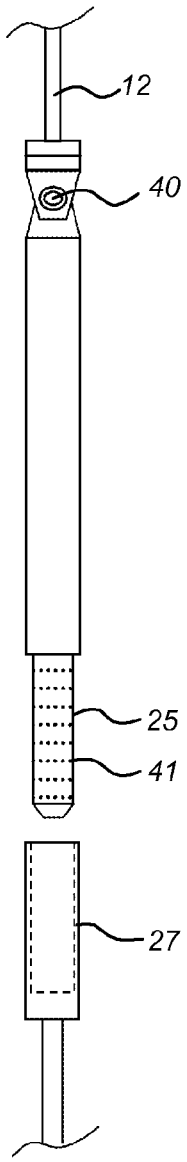
Figure 5:
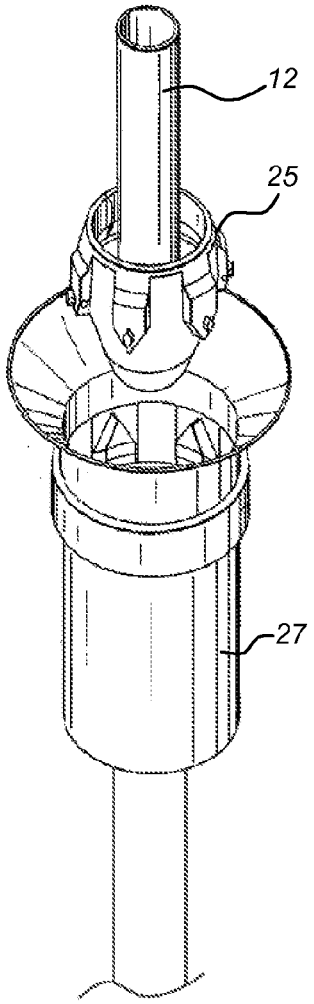

An embodiment of a floating construction comprising the tendons according to the present invention will, by way of example, be explained in detail with reference to the accompanying drawings. In the drawings:

FIG. 1 shows a schematic side view of a TLP according to the present invention with the connecting tendon segments in a retracted position, FIG. 2 shows the TLP of FIG. 1 with the connecting tendon segments attached to the lower tendons via a guide wire, prior to connection, and FIG. 3 shows the TLP of FIG. 1 with the upper tendon segments and the lower tendons connected, FIG. 4 shows a first embodiment of a connector suitable for use with the tensioning system of the present invention, and FIG. 5 shows a second embodiment of a connector suitable for use with the tensioning system of the present invention, and

DETAILED DESCRIPTION OF THE INVENTION

FIG. 1 shows a tension leg platform 1 with a base comprising a hull 2 and with four support columns 5, 6 to which super structure carrying exploration and/or processing equipment may be attached. The hull 2 is floating at the water surface and the TLP is towed to its installation site in this position. At the corners 7, 8 of the hull 2 tendon sections 12, 13 are supported in guide sleeves 14, 15 to be lowered and raised, respectively, towards and away from vertically oriented pre-installed tendons 17, 18 that with their lower ends 20, 21 are attached to the sea bed 22.

Each tendon section 12, 13 is at an upper end 31, 32 provided with a stop member 33, 34 for engaging with the guide sleeves 14, 15 to vertically fix the position of each tendon section 12, 13. Each tendon section 12, 13 is at a lower free end 23, 24 provided with a connector 25, 26, such an hydraulically or mechanically operated male or female connector, which can engage with a complementary connector 27, 28 at the end of each pre-installed tendon 17, 18. Each tendon 17, 18 is kept in a vertical orientation by an upward force exerted on the tendon via buoyancy members 29, 30 at their upper ends 16, 19.

FIG. 2 shows the TLP 1 in a ballasted state in which the hull 2 is submerged below sea level 35 by a depth D1 of for instance 30 m or 100 m or more (150 m) for a deep draft TLP. The upper ends 33, 34 are attached to a cable 36, 37, wherein each cable is connected to an individual winch 38, 39. The lower ends 23,24 of tendon section 12, 13 are attached to a guide wire 40, 41, one end of which is attached to the upper end 16,19 of a respective tendon 17, 18 by divers or by ROV. Next, the tendon sections 12, 13 are lowered over a length D2 of 1 m-200 m, preferably 5-50 m by driving the winches 38, 39 and paying out the cables 36, 37 such that the tendon sections 12, 13 slide downwardly along the guide sleeves 14, 15 and the connectors 25, 26 follow the guide wires 40, 41 until they reach the complementary connectors 27, 28. After mating of the connectors 25, 27 and 26, 28, the tendons 17, 18 may be tensioned by either deballasting the hull 2, or by pulling the tendons upward via winches 38, 39, or both. After tensioning of the tendons, the cables 36, 37 may be detached, as shown in FIG. 3 and the stop members 33, 34 engage with the guide sleeves 14, 15.

FIG. 4 Shows a known connection 25, 27 for use in the tensioning system in which the connector 25 is attached in a pivot point to the tendon section 12. The rod-shaped pivot point 40 to the tendon section 12. The rod-shaped connector 25 comprises projections 41 on its outer surface which lock into recesses on the receiving sleeve of complementary connector 27 upon insertion of the connector rod therein. The connector 25, 27 of FIG. 4 is described in detail in WO 2004/055394.

FIG. 5. shows an alternative connector 25, 27 in which a conical head of connector 25 is locked into a tapering receiving sleeve of complementary connector 27. The connector 25, 27 of FIG. 5 is described in detail in U.S. Pat. No. 4,943,188.

The invention claimed is:

1. A method of installing a floating structure comprising a hull having a base (2), comprising:

providing pre-installed vertically oriented tendons (17,18) having upper ends (16,19) submerged below sea level at an installation site;

floating the structure to the installation site;

ballasting the structure to an installation draft level;

lowering a tendon section (12,13) from the base by a distance below a bottom of the base (2), substantially in line with a respective pre-installed tendon (17,18), towards an upper end of the respective pre-installed tendon which at its upper end is provided with a connector (27,28), via a pulling device (36,37,38,39) on the floating structure that is attached to the tendon section (12, 13);

connecting the connector at an upper end of the pre-installed tendon with a complementary connector (25,26) at a lower end of the tendon section;

fixing the tendon section on the base; and exerting a tensioning force on the interconnected tendon and tendon section by deballasting the base and placing the base in a moored state wherein a lower end of the tendon section is placed at a distance (D2) below the bottom of the base of between 1 m and 200 m.

2. The method according to claim 1, wherein the complementary connector is lowered along a guide wire towards the connector on the pre-installed tendon.

3. The method according to claim 1, wherein the complementary connector is lowered towards the connector on the tendon via a remote operating vehicle.

4. The method according to claim 1, wherein the lower end of the tendon section is placed at the distance (D2) below the bottom of the base of between 5 m and 50 m.

5. A floating structure (1), comprising:

a hull having a base (2);

a tendon (17, 18) extending from a sea bed in a direction of the base; a connector (27, 28) at an upper end (16, 19) of the tendon (17,18); and a tendon section (12, 13) connected at an upper end thereof to the base and having at a lower end a complementary connector (25, 26) attached to the connector (27, 28), the connectors being situated at a distance (D2) below the base bottom wherein the distance (D2) in a moored state of the floating structure construction is between 1 m and 200 m; and wherein the attachment is accomplished by lowering the tendon section (12, 13) from the floating structure.

6. The floating structure according to claim 5, wherein the base comprises for each tendon section a respective relatively light-weight pulling device (36,37,38,39) that is adapted for lowering of a respective tendon section, the pulling device having a raising power that is lower than the power required for pulling down the floating structure to a deeper draft level.

7. The floating structure according to claim 5, wherein the tendon (17,18) is provided with a buoyancy member (29,30) at or near the connector (27, 28).

8. The floating structure according to claim 5, wherein in the moored state the distance (D2) of the floating construction is between 5 m and 50 m.

9. A floating construction (1), comprising:

a hull having a base (2);

a tendon (17, 18) extending from the sea bed in the direction of the base;

a connector (27, 28) at an upper end (16, 19) of the tendon; and attachment means (12, 13, 14, 15, 25, 26, 33, 34) on the base for attaching to the connector (27, 28), the attachment means comprising a guide member (14, 15) for lowering a tendon section (12, 13) by a predetermined distance (D2) below a bottom of the base (2), the tendon section (12,13) at a free end (23, 24) being provided with a complementary connector (25, 26) for attaching to the connector (27, 28) on the upper end (16, 19) of the tendon (17, 18), the tendon section comprising at an upper end (31, 32) a stopper (33, 34) for engaging with the guide member (14,15) and for tensioning the tendons (17,18) upon deballasting of the base (2), the floating construction comprising a pulling device (36, 37, 38, 39) attached to the tendon section (12, 13), for lowering the tendon section (12, 13) along the guide member (14, 15) towards the tendon (17, 18), until the upper end (31, 32) is fixed in a vertical direction and the lower end of the freely depending tensioning member section (12,13) extends substantially in line with the tensioning member (17,18) while the complementary connector (25,26) is situated at the predetermined distance (D2) below the bottom wherein the predetermined distance (D2) in the moored state of the floating construction is between 1 m and 200 m.

10. The floating structure according to claim 9, wherein in the moored state the distance (D2) of the floating construction is between 5 m and 50 m.

* * * * *